US007179125B2

(12) United States Patent
Chen et al.

(10) Patent No.: US 7,179,125 B2
(45) Date of Patent: Feb. 20, 2007

(54) MOUNTING DEVICE FOR CONNECTOR

(75) Inventors: Yun-Lung Chen, Tu-Cheng (TW); Yi-Chung Hsiao, Tu-Cheng (TW)

(73) Assignee: Hon Hai Precision Industry Co. Ltd. (TW)

( * ) Notice: Subject to any disclaimer, the term of this patent is extended or adjusted under 35 U.S.C. 154(b) by 0 days.

(21) Appl. No.: 11/318,161

(22) Filed: Dec. 22, 2005

(65) Prior Publication Data

US 2006/0240708 A1 Oct. 26, 2006

(30) Foreign Application Priority Data

Apr. 22, 2005 (CN) ..... 2005 2 0057624

(51) Int. Cl.
*H01R 13/648* (2006.01)

(52) U.S. Cl. ..... 439/607; 439/573; 439/373; 248/211.11; 361/816

(58) Field of Classification Search ..... 439/607, 439/373–573; 248/211.11; 361/816
See application file for complete search history.

(56) References Cited

U.S. PATENT DOCUMENTS

| | | | | |
|---|---|---|---|---|
| 5,409,394 | A * | 4/1995 | Astier | 439/347 |
| 6,113,426 | A | 9/2000 | Lin | |
| 6,210,216 | B1 * | 4/2001 | Tso-Chin et al. | 439/545 |
| 6,276,952 | B1 * | 8/2001 | Ferranti et al. | 439/345 |
| 6,307,756 | B1 | 10/2001 | Liu et al. | |

* cited by examiner

*Primary Examiner*—Truc Nguyen
(74) *Attorney, Agent, or Firm*—Morris Manning & Martin; Tim Tingkang Xia, Esq.

(57) ABSTRACT

A mounting device for mounting a connector (30) to a panel (10) includes a shield (20). The panel defines a plurality of slits (15) and a hole (13) therein. Each slit defines a wide portion (151) and a narrow portion (153) communicating with the wide portion. The shield is adapted to receive the connector therein. The shield forms a plurality of hooks (25) and a rivet (26). The hooks extend through the wide portions of the slits, then slide to the narrow portions to engage with the panel. And the rivet extends through the hole to be riveted to the panel to firmly secure the shield with the connector to the panel.

17 Claims, 3 Drawing Sheets

MOUNTING DEVICE FOR CONNECTOR

BACKGROUND OF THE INVENTION

1. Field of the Invention

The present invention relates to a mounting device, and more particularly to a mounting device for mounting a connector.

2. General Background

Connectors for transferring signals and power, such as USB (Universal Serial Bus) connectors and IEEE 1394 connectors, are soldered to a motherboard. Openings are defined in a rear panel of a computer enclosure to expose the connectors for connection with other peripheral devices. However, when installing a mouse, a keyboard, or a joystick to a computer with this kind of connector layout, users have to plug the connectors into the rear panel from the rear side of the computer, which causes great inconvenience to the users especially when the computer is placed in front of a wall.

To solve the problem, USB connectors and IEEE 1394 connectors are mounted to a motherboard in a way to give access through a front panel of a computer allowing peripheral devices to be directly attached to the computer from the front side. A typical connector mounting method is to directly screw the connector to the panel. However, the manual pre-alignment with several different screw holes defined in the connector assembly, the mating connector, and the panel causes the installment of the connector to be inconvenient and time-consuming.

What is needed, therefore, is a mounting device allowing convenient and speedy mounting of a connector to a front panel of a computer.

SUMMARY

A mounting device for mounting a connector to a panel includes a shield. The panel defines a plurality of slits. Each slit defines a wide portion and a narrow portion. The shield is adapted to receive the connector therein. The shield forms a plurality of hooks and a rivet. The hooks extend through the wide portions of the slits, then slide to the narrow portions to engage with the panel. And the rivet is riveted to the panel to secure the shield with the connector to the panel.

Other advantages and novel features will be drawn from the following detailed description of a preferred embodiment with attached drawings, in which:

DETAILED DESCRIPTION OF THE EMBODIMENTS

Figure 1:
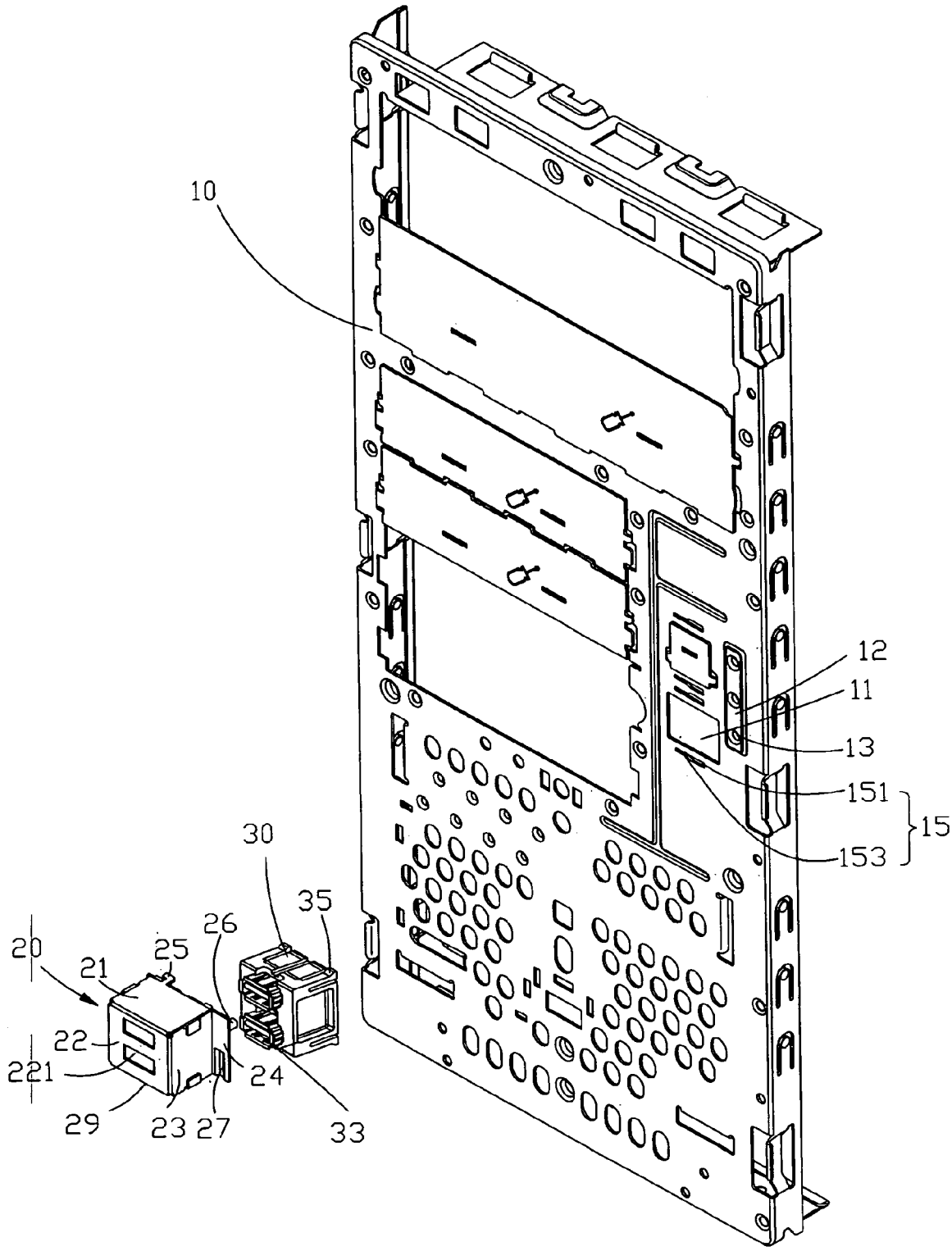
FIG. 1 is an exploded, isometric view of a preferred embodiment of a mounting apparatus which includes a shield pre-mounting a connector to a front panel of a computer.
Figure 2:
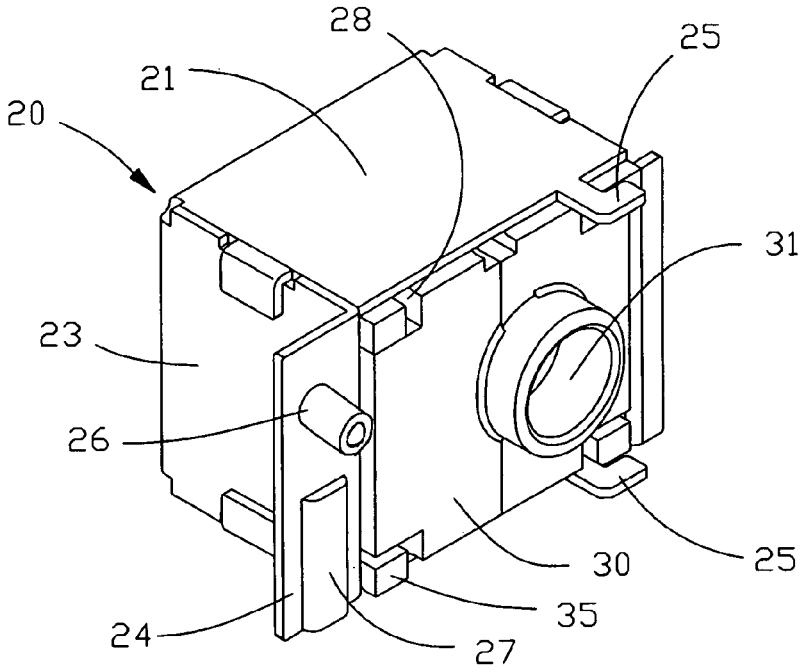
FIG. 2 is an isometric view of the connector received in the shield of FIG. 1.

Referring to FIGS. 1 and 2, a mounting device in accordance with a preferred embodiment of the present invention includes a shield 20. A connector 30 made as a connector module is to be received in the shield and mounted to a front panel 10 of a computer chassis (not shown).

The front panel 10 is set on a front side of the chassis, and a decorative bezel (not shown) is mounted on the front panel 10. The USB connector is mounted in the front panel 10, and extends through an opening defined in the bezel to be exposed to the user for convenient use. An opening 11 is defined in the front panel 10. The front panel 10 defines a pair of slits 15 above and below the opening 11 respectively. Each slit 15 includes a wide portion 151 and a narrow portion 153 communicating with the wide portion 151. A protruded platform 12 protrudes from the front panel 10 near the opening 11. A plurality of holes 13 is defined in the platform 12.

The shield 20 includes a top plate 21, a front plate 22, a bottom plate 29, a pair of side plates 23, and an uncovered side 28 opposite the front plate 22. Front edges of the top plate 21 and the bottom plate 29 protrude forward to from a pair of L-shaped hooks 25, corresponding to the pair of slits 15 of the front panel 10. A flange 24 is bent from a free edge of one of the side plates 23. The flange 24 forms a rivet 26 at an upper portion thereon, and a protrusion 27 at a lower portion thereon. A pair of slots 221 is defined in the front plate 22. A pair of tabs (not labeled) extends from corresponding two opposite side edges of the top plate 21 and the bottom plate 29, respectively, toward each of the pair of side plates 23 to abut against an outer surface of each side plate 23 in order for confining movement of each side plate 23 relative to the top plate 21 and the bottom plate 29.

The connector 30 includes a pair of interfaces 33 in the front side thereof corresponding to the pair of slots 221, and a coil in hole 31 in the rear side thereof. Each corner of the connector 30 extends rearward to form a cantilever 35. A rear side of the connector 30 is larger than the opening 11 of the front panel 10.

Figure 3:
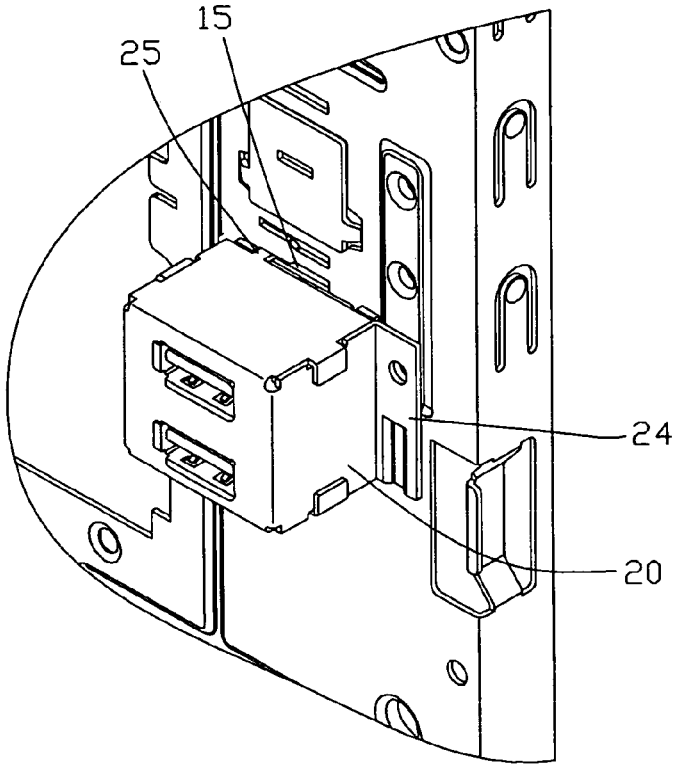
FIG. 3 is a partial, isometric view of the shield with the connector mounted on the front panel of FIG. 1.
Figure 4:
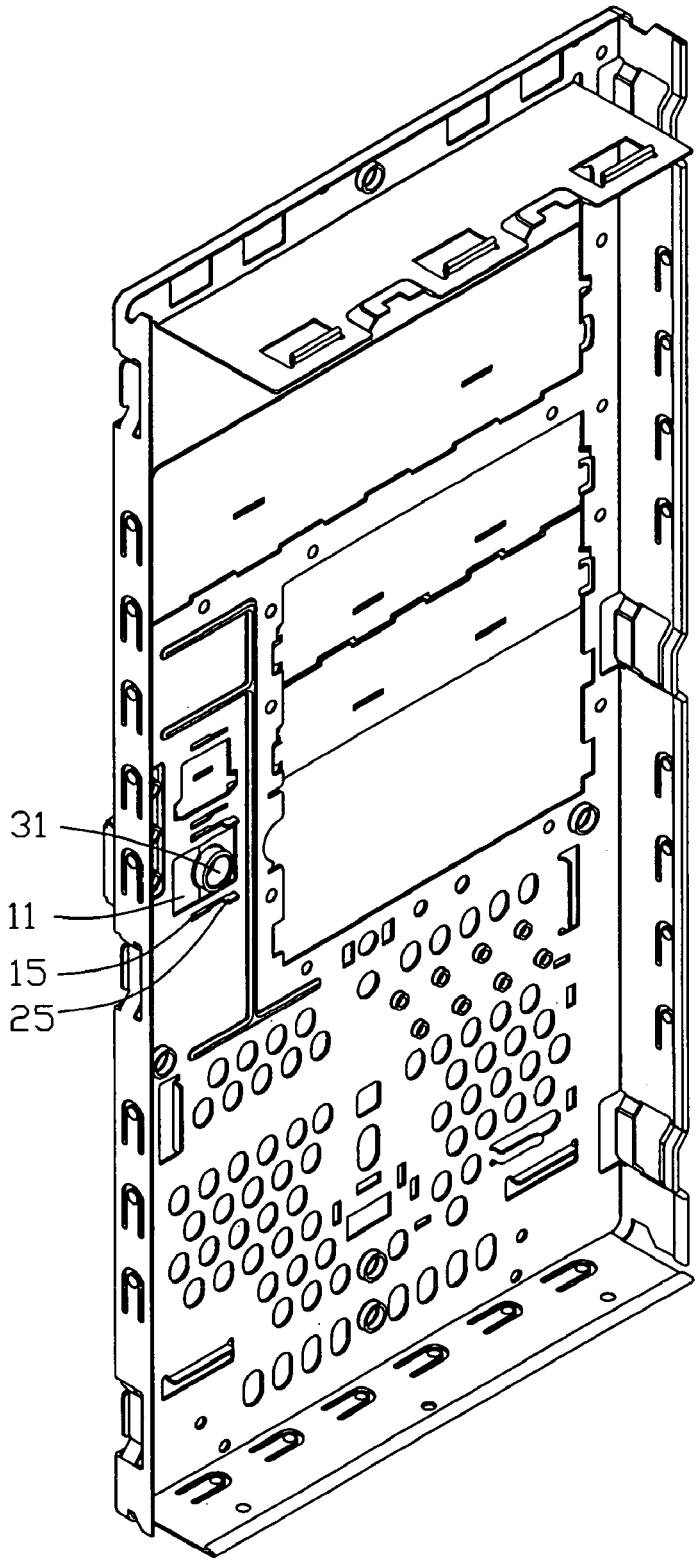
FIG. 4 is similar to FIG. 3, but viewed from another aspect.

Referring to FIGS. 2, 3, and 4 in assembly, the connector 30 is inserted into the shield 20 from the uncovered side 28. The cantilevers 35 of the connector 30 are resiliently deformed by the edges of the shield 20, until the front side of the connector 30 resists the front plate 22 and the interfaces 33 are in alignment with the slot 221. Then, the shield 20 moves towards the opening 11 of the front panel 10, until the rear side of the connector 30 resists the edges of the opening 11, and the coil in hole 31 extends through the opening 11 for connecting to a motherboard. The pair of hooks 25 extend through the wide portions 151 of the pair of slits 15 simultaneously. Then, the hooks 25 slide in the slits 15 from the wide portions 151 to the narrow portions 153 causing the hooks 25 to engage with the front panel 10. The shield 20 inclines allowing the rivet 26 to extend through the hole 13. The flange 24 abuts the platform 12, and the protrusion 27 abuts the front panel 10. The rivet 26 is stamped to secure the shield 20 to the front panel 10.

It is to be understood, however, that even though numerous characteristics and advantages have been set forth in the foregoing description of preferred embodiments, together with details of the structures and functions of the preferred embodiments, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. A mounting device for mounting a connector to a panel, the mounting device comprising:

a plurality of slits defined in the panel, each slit defining a wide portion and a narrow portion;

a undeformed shield for receiving the connector therein, the shield forming a plurality of hooks and a rivet; and a plurality of resilient cantilevers formed on a rear side of the connector, the connector inserted in the undeformed shield with the rear side of the connector exposed out of the shield, and the cantilevers being resiliently deformed by an interior of the shield to retain the connector in the shield;

wherein the hooks are for extending through the wide portions of the slits, and sliding to the narrow portions to engage with the panel, and the rivet is riveted to the panel to secure the shield with the connector to the panel.

2. The mounting device as described in claim 1, wherein the panel defines a hole for the rivet extending therethrough.

3. The mounting device as described in claim 1, wherein the panel defines an opening configured to be smaller than the rear side of the connector so that when the connector is received in the shield, the rear side of the connector resists against a portion of the panel adjacent the opening to sandwich the connector between the shield and the panel.

4. The mounting device as described in claim 1, wherein the shield defines a plurality of slots corresponding to the interfaces of the connector.

5. The mounting device as described in claim 1, wherein the hooks are L-shaped.

6. The mounting device as described in claim 1, wherein the shield comprises a flange, and the rivet is formed on the flange.

7. The mounting device as described in claim 1, wherein the shield comprises a top plate, a bottom plate and a pair of side plates extending between the top and bottom plates at opposite side edges thereof, at least one tab extends from the opposite side edges of the top and bottom plates toward each of the pair of side plates and abuts against the each side plate, respectively, to confine movement of the each side plate relative to the top and bottom plates.

8. The mounting device as described in claim 6, wherein a protrusion is formed on the flange to abut the panel, and a platform is formed on the panel to abut the flange.

9. A mounting device for mounting a connector to a panel, the mounting device comprising:

a plurality of slits defined in the panel;

a hole defined in the panel;

a shield configured for receiving the connector therein, the shield forming a plurality of hooks configured for engaging in corresponding slits of the panel, and a rivet configured for engaging in the hole of the panel so as to cooperatively secure the shield to the panel; and an opening defined in the panel, the opening being configured to be smaller than a rear side of the connector so that when the connector is received in the shield, the rear side of the connector resists against a portion of the panel adjacent the opening to sandwich the connector between the shield and the panel.

10. The mounting device as described in claim 9, wherein each slit defines a wide portion and a narrow portion.

11. The mounting device as described in claim 9, wherein the shield defines a plurality of slots corresponding to the interfaces of the connector.

12. The mounting device as described in claim 9, wherein the mounting device comprises a plurality of cantilevers formed on the rear side of the connector so that when the connector is inserted in the shield, the cantilevers are resiliently deformed by an interior of the shield to retain the connector in the shield.

13. The mounting device as described in claim 9, wherein the hooks are L-shaped.

14. The mounting device as described in claim 9, wherein the shield comprises a flange, and the fastener is formed on the flange.

15. The mounting device as described in claim 14, wherein a protrusion is formed on the flange to abut the panel, and a platform is formed on the panel to abut the flange.

16. A mounting device of an electronic device comprising:

a panel of a chassis of an electronic device extending along a side of said chassis which defines a space therein to accommodating components of said electronic device; and a shield of a connector module enclosing said connector module and reachably engagable with said panel to removably attach said connector module to said panel, said shieldmovable together with said connector module to abut against said panel along a normal direction of said pane, and sequentially movable along said panel to prevent said shield and said connector module from movement along said normal direction of said panel, said shield comprises a top plate, a bottom plate and a pair of side plates extending between said top and bottom plates at opposite side edges thereof, at least one tab extends from said opposite side edges of said top plate and said bottom plate toward each of said pair of side plates and abuts against said each of said pair of side plates, respectively, to confine movement of said each of said pair of side plates relative to said top and bottom plates.

17. The mounting device as described in claim 16, wherein said shield comprises a rivet engagable with said panel to prevent said shield and said connector module from movement along said panel.

* * * * *